US005687695A

United States Patent [19]

Tsukamoto et al.

[11] Patent Number: 5,687,695

[45] Date of Patent: Nov. 18, 1997

[54] AIR FLOW RATE CONTROL DEVICE OF ENGINE AND DRAINING OFF METHOD THEREOF

[75] Inventors: Noboru Tsukamoto; Shigeo Tamaki, both of Hitachinaka, Japan

[73] Assignees: Hitachi, Ltd.; Hitachi Car Engineering Co., Ltd., both of Japan

[21] Appl. No.: 683,536

[22] Filed: Jul. 15, 1996

[30] Foreign Application Priority Data

Jul. 25, 1995 [JP] Japan ..... 7-189538

[51] Int. Cl.[6] ..... F02M 3/08; F02M 15/02

[52] U.S. Cl. ..... 123/339.1; 123/339.27

[58] Field of Search ..... 123/339.1, 339.14, 123/339.27, 585

[56] References Cited

U.S. PATENT DOCUMENTS

| | | | |
|---|---|---|---|
| 4,438,049 | 3/1984 | Ammons | 123/339.1 |
| 4,580,536 | 4/1986 | Takao et al. | 123/339.27 |
| 4,617,889 | 10/1986 | Nishimiya et al. | 123/339.27 |
| 4,989,564 | 2/1991 | Cook et al. | 123/339.27 |
| 5,090,381 | 2/1992 | Tanabe | 123/339.27 |
| 5,261,371 | 11/1993 | Sumida et al. | 123/339.27 |

FOREIGN PATENT DOCUMENTS

| | | |
|---|---|---|
| 62-246672 | 10/1987 | Japan . |
| 63-100268 | 5/1988 | Japan . |

*Primary Examiner*—Willis R. Wolfe

*Attorney, Agent, or Firm*—Evenson, McKeown, Edwards & Lenahan, P.L.L.C.

[57] ABSTRACT

In an air flow rate control apparatus having an idle revolution speed control apparatus, in order to prevent the measuring part from freezing by water drops in the idle revolution speed control apparatus, and in order to layout an engine room easily and freely, a perpendicular cavity 9 of cylinder type is formed in a base part 2B of a throttle body 2, in which a bottom part of the cavity 9 is closed by a seal plug 7 and an upper part of the cavity 9 is led to a boa 3 of a cylinder portion 2A, and a bottom par of the perpendicular cavity 9 is arranged lower than a bottom end of aperture part 10 of an air passage and a water pool portion 9B is formed thereunder. Furthermore, a passage section lower part of an air-outlet passage 22*a*, 22*b* of a ISC valve 5 is arranged lower than the measuring part 39*a*, 39*b* of the bottom end. The water in the measuring part of the ISC valve 5 is pooled in the water pool portion 9B while the engine stops, and the water in the water pool portion is absorbed so as to be drained by a cranking negative pressure through the boa 3 of the throttle body.

14 Claims, 12 Drawing Sheets

AIR FLOW RATE CONTROL DEVICE OF ENGINE AND DRAINING OFF METHOD THEREOF

BACKGROUND OF THE INVENTION

The present invention relates to an air flow rate control apparatus and a drain off method therein for controlling an air flow rate inspilated by an engine of a car, and particularly relates to an air flow rate control apparatus having an idle revolution speed control apparatus(ISC valve) which keeps idle revolution at a desired revolution speed decided beforehand depending on condition of engines such as a water temperature or outside atmospheric temperature and a drain off method of the air flow rate control apparatus.

The idle revolution speed control apparatus(ISC valve) which detects a condition of the car engine and controls the idle revolution speed in the desired revolution speed depending on the condition is usually installed on a manifold of the engine. However, in recent years, the idle revolution speed control apparatus is frequently installed on an air flow rate control valve called a throttle body because of a limited volume of engine room. Bulletins of Japanese Patent Laid-Open No. 62-246672(1987),63-100268(1988) etc. are disclosed as examples of such cases stated above.

In the Japanese Patent Laid-Open No. 62-246672(1987) bulletin, the idle revolution speed control apparatus os installed on an upper part of the laterally disposed throttle body. In a measuring part of the air flow rate of the idle revolution speed control apparatus and an air passage which is provided on the engine side, an axial center of the air passage generally corresponds with an axial center of the measuring part in construction as shown in this bulletin. This aims at ease of construction and an effect which enables a pneumatic flow to quickly become stable after the measurement.

On the other hand, in the Japanese Patent Laid-Open No. 63-100268(1988) bulletin, the idle revolution speed control apparatus is disposed under the lateral throttle body. A drain passage for preventing blow-by gas, water droplets or blow back fuel from being accumulated in the valve mechnism is provided so as to connect to a suction pipe located in a down stream of the throttle body.

As the upper space of an engine manifold is small, it isn't practical to install the idle revolution speed control apparatus on the laterally disposed throttle body as shown in Japanese Patent Laid-Open 62-246672 (1987) bulletin. However, in the case where the idle revolution speed control apparatus is installed under the laterally disposed throttle body, a condensation accumulated in the throttle body and water droplets from an air cleaner pipe arrangement gradually accumulate in the idle revolution speed control apparatus because of their self-weight. When the water accumulate s in a part contacting with a measuring part, the water freezes in cold districts and the valve seat of the measuring part may malfunction as a result. Thereby, air capacity which is necessary for starting the engine becomes short because of the malfunction, and starting becomes difficult or at worst impossible.

In a prior art shown in the Japanese Patent Laid-Open 63-100268(1988) bulletin, the drain passage provided so as to prevent blow-by gas, the water droplets and the blow back fuel from being accumulated in the valve structure is installed so as to connect with the suction pipe located in the down stream of the throttle body. Thereby, the above problem of freezing may be solved. But, it is needed to provide a lane passage between the idle revolution speed control apparatus and the suction pipe, and construction therefor becomes complicated. Further, because of a difference in height between the idle revolution speed control apparatus and the engine, it becomes impossible to apply it in a small engine system. More specifically, in a system requiring such a difference, freedom of layout of engine room is restricted. Also, a drain passage may be clogged up with carbon of the blow-by gas and here too there is a problem that starting reliability is impeded.

SUMMARY OF THE INVENTION

An object of the present invention in an air flow rate control apparatus having an idle revolution speed control apparatus is in preventing a measuring part from freezing by water droplets in an idle revolution speed control apparatus, also in making the engine room layout free, and providing an air flow rate control apparatus and a drain off method with high reliability.

The present invention adopts a following construction to achieve the above object. That is, in the air flow rate control apparatus controlling an air flow rate according to condition of the engine, wherein the idle revolution speed control apparatus is installed under the throttle body. By detouring around a throttle butterfly, an upper side of the throttle body is connected to the boa of the throttle body by the idle revolution speed control apparatus, and is characterised by an air passage from measuring part of idle revolution speed control apparatus to the boa of the throttle body, a water pool portion having an upper part opened upward in the air passage mentioned above and a closed bottom part located lower than the measuring part mentioned above and an air passage between the measuring part above and the water pool portion serves as a drain passage in which water from the measuring part falls to the water pool mentioned above.

Preferably in the above air flow rate control apparatus, the bottom of the air passage between the measuring part of the idle revolution speed control apparatus and the water pool is disposed at the same level or lower than the level of the bottom end of the measuring part.

Further preferably, the air passage between the measuring part of the idle revolution speed control apparatus and the water pool is disposed the axial center of the measuring part.

Further preferably, one more water pool having a bottom being at the same level or lower than the bottom end of the measuring part is provided in a portion inside the measuring part, leading to the measuring part of the air passage.

Further preferably, a hot water passage passing through both the throttle body and the idle revolution speed control apparatus is provided.

Further the present invention adopts a following construction to achieve the above purpose. In an air flow rate control apparatus for controlling the air flow rate according to the condition of engine, comprising an idle revolution speed control apparatus installed under the throttle body, and the upper side of said throttle body being connected to the boa of the throttle body by detourig the throttle valve provided in the boa of the throttle body by this idle revolution speed control apparatus, wherein characterised by said throttle body comprising a tube portion forming the boa mentioned above and a base part for installing the idle revolution speed control apparatus under the tube portion, a perpendicular cavity provided on the base portion as a part of the air passage led from the measuring part of the idle revolution speed control apparatus to the boa of throttle body, a bottom of the perpendicular cavity disposed lower than the measuring part, and the water pool formed under the perpendicular cavity, thereby the air passage between the measuring part and the water pool serves as the drain passage that water of the measuring part falls to the water pool.

Preferably in this case, the passage bottom of the air passage part between the measuring part of idle revolution speed control apparatus mentioned above and water pool portion is disposed at the same or lower than the bottom end of the measuring part.

Further the present invention adopts a following construction to achieve the above purpose. In an air flow rate control apparatus for controlling the air flow rate according to the condition of engine, comprising the idle revolution speed control apparatus installed under the throttle body, upper side of said throttle body being connected with the boa of the throttle body by detourig the throttle valve provided in the boa of the throttle body by this idle revolution speed control apparatu, a hot water passage passing through both of the throttle body and the idle revolution speed control apparatus is provided, the throttle body has the tube portion forming the boa and the base portion having a jointing surface on which the idle revolution speed control apparatus is installed under the tube portion, the idle revolution speed control apparatus has an installation flange portion having the jointing surface on which the idle revolution speed control apparatus is installed, and the hot water passage mentioned above is opened towards both of the jointing surface of the base portion and the jointing surface of the flange portion and extends over both of the base portion and the flange portion.

Preferably in the above air flow rate control apparatus, the perpendicular cavity is provided so as to form one part of the air passage led from the measuring part of the idle revolution speed control apparatus to the boa of the throttle body at the base portion of the throttle body, a bottom of this perpendicular cavity is disposed lower than the measuring part so that a water pool portion is formed under the perpendicular cavity, and an air passage part between the measuring part and the water pool portion serves as a drain passage where the water in the measuring part falls to the water pool portion.

Preferably, a part of the air passage led from the measuring part of the idle revolution speed control apparatus to the boa of the throttle body is provided, the air passage is opened to the jointing surface on the base portion of the throttle body, and a part of the air passage is led from the measuring part to the boa of throttle body is provided, the air passage opened to the installation flange department is formed in the idle revolution speed control apparatus, and furter an aperture of the air passage on the jointing surface and an aperture of the hot water passage are sealed with an oil seal of a double ring type.

The present invention adopts a following construction to achieve the above object.

In an air flow rate control apparatus for controlling the air flow rate according to the condition of engine, comprising the idle revolution speed control apparatus installed under the throttle body, the upper side of the throttle body being connected to the boa of the throttle body by detourig the throttle valve installed in the boa of the throttle body with the idle revolution speed control apparatu, the water in the measuring part of the idle revolution speed control apparatus is pooled in the water pool provided in the air passage led from the measuring part to the boa of the throttle body while the engine stops, and the water pooled in the water pool is drained by a inspiration negative pressure arisn by a clanking motion through the boa of the throttle body when the engine starts.

In the air flow rate control apparatus has the idle revolution speed control apparatus (ISC valve) under the throttle body in the present invention stated as above, the water pool is provided in the air passage led from the ISC valve to boa of the throttle body, the water on the measuring part of the ISC valve gathers in the water pool when the engine stops by letting the air passage from the metering portion of the ISC valve to the water pool serve as the drain passage, and the water gathered in the water pool is drained by an inspiration negative pressure arisn by a cranking motion through the boa of the throttle body when the engine starts. Therefore, the measuring part of the ISC valve is prevented from being freezed in a chilly time and the starting of the engine is secured. Also, as the water gathered in te water pool is abosorbed from the boa of the throttle body by utilyzing a negative pressure by the cranking in the engine starting, the passage does not clog up with carbon arised by the blow-by gas, and high reliability to the freezing protection is secured. Also, as any special passage for draining the water from the pool is not needed, a construction therefor becomes extremely simple.

Furthermore, as any special passage for draining from the water pool is not needed as stated above, when the throttle body is installed laterally, the ISC valve may be installed under the throttle body if there is not difference in a height between the ISC valve and the engine, and freedom for the engine room layout is easily secured.

Also, as the passage section bottom in the air passage between the measuring part of the ISC valve and the water pool is disposed at the same or lower than the bottom end of the measuring part, the air passage has a function as a drain naturally.

The air passage between the measuring part and the water pool of the ISC valve is disposed downwards in eccentricity than the axis center of the measuring part and the passage bottom of the air passage becomes lower than the bottom end of the measuring part, therefore, the air passage has a function as a drain naturally.

Furthermore, in a part connected to the measuring part of the air passage inside of the measuring part, another water pool having a bottom being at the same or lower than the bottom end of the measuring part, and water from the upper flow of the measuring part inside of the air passage is pooled in the water pool, thereby the measuring part is prevented from being sticked the water till water level of the water pool rises upto the level of measuring part Also, a hot water passage passing through both of the throttle body and the ISC valve, both of the throttle body and the ISC valve are heated simultaneously after the engine started, and icing in the measuring part is prevented after engine started, thereby appropriate road holding of the car is secured.

Furthermore, the base portion installed on the ISC valve is disposed lower than the tube portion of the throttle body, a perpendicular cavity is provided as a part of the air passage in the base portion, and a water pool is formed under the perpendicular cavity by disposing the bottom of the perpendicular cavity lower than the measuring part, a water pool having a simple construction is provided without changing conventional construction greatly.

An installation flange portion having a jointing surface touching said jointing surface of the base portion is provided on the ISC valve, a portion across over the jointing surface of the installation flange portion and the jointing surface of the base portion is provided in the hot water passage, thereby a hot water passage passing through both of the throttle body and the ISC valve with a simple construction is provided without changing conventional construction greatly.

Furthermore, the aperture portion of the air passage and the aperture portion of the hot water passage on a surface for fitting the base department and the installation flange portion are sealed by an oil seal of double ring type, thereby both of the passages are easily separated and isolated and an air tightness of the air passage may be secured.

DETAILED DESCRIPTION OF THE EMBODIMENTS

Embodimnets of the present invention will be explained using drawings as follows. First of all, a first embodiment applied to the air flow rate control apparatus having a proportional type ISC valve as an idle revolution speed control apparatus in the present invention will be explained using FIGS. 1 to 10.

Figure 1:
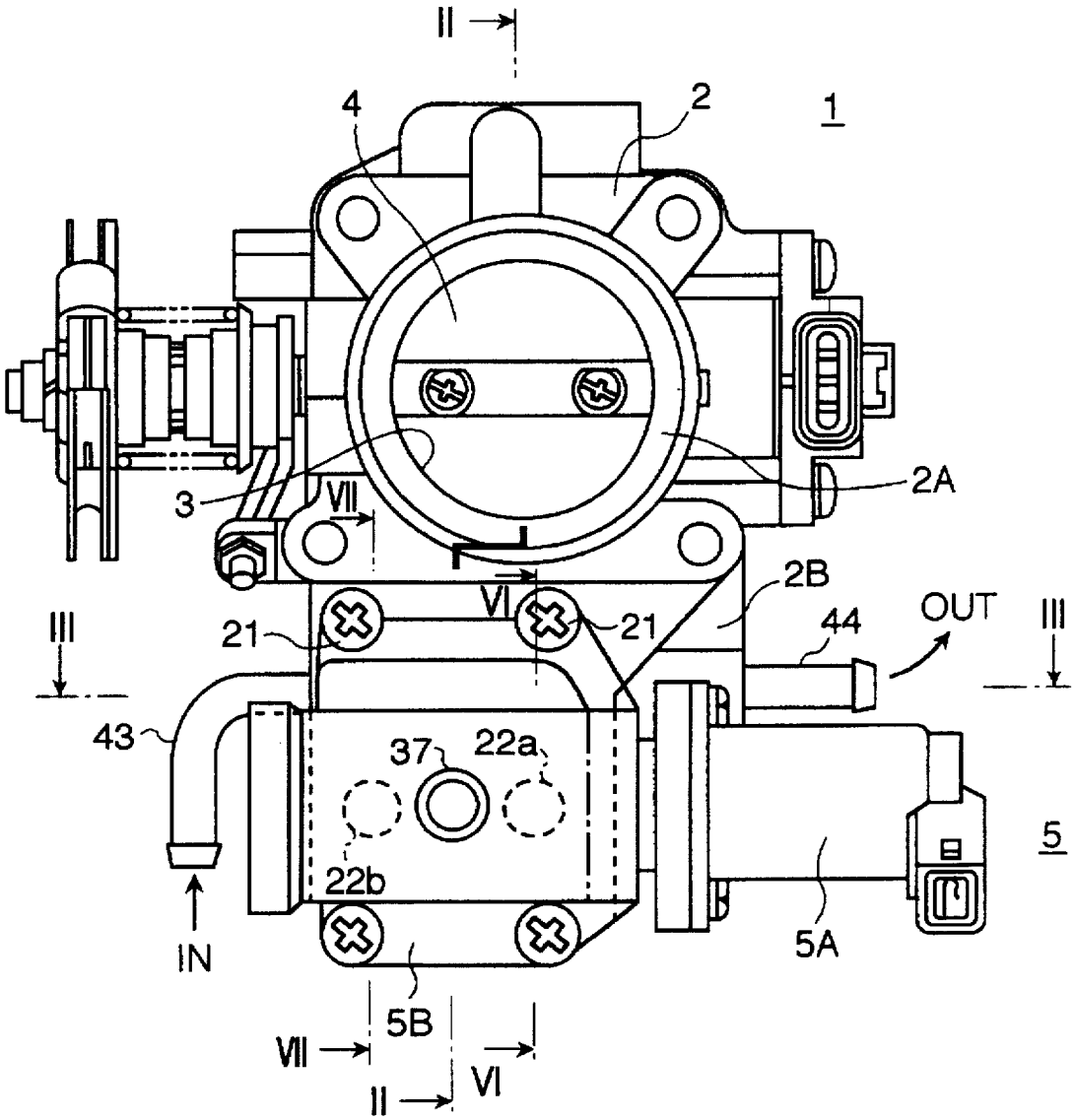
FIG. 1 shows a front view of an air flow rate control apparatus as an embodiment of the present invention.
Figure 2:
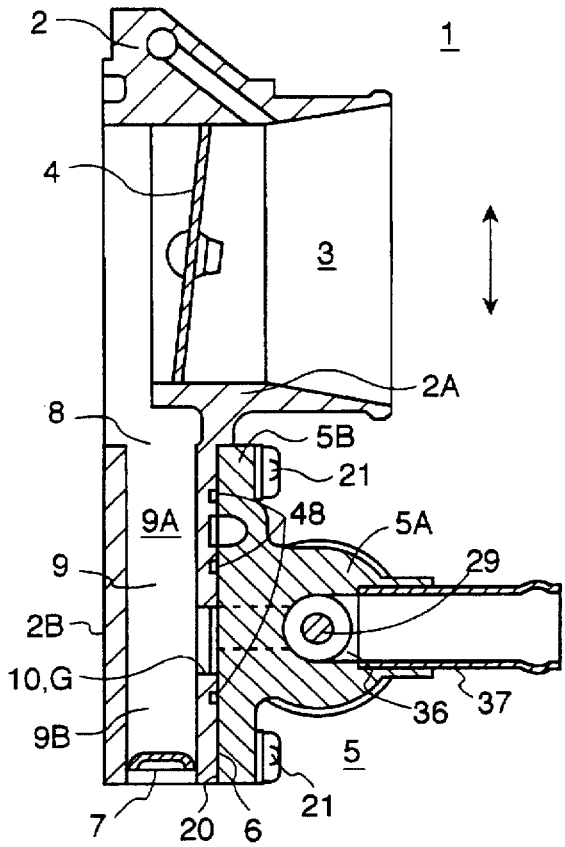
FIG. 2 shows a sectional view in a line II—II of the FIG. 1.
Figure 3:
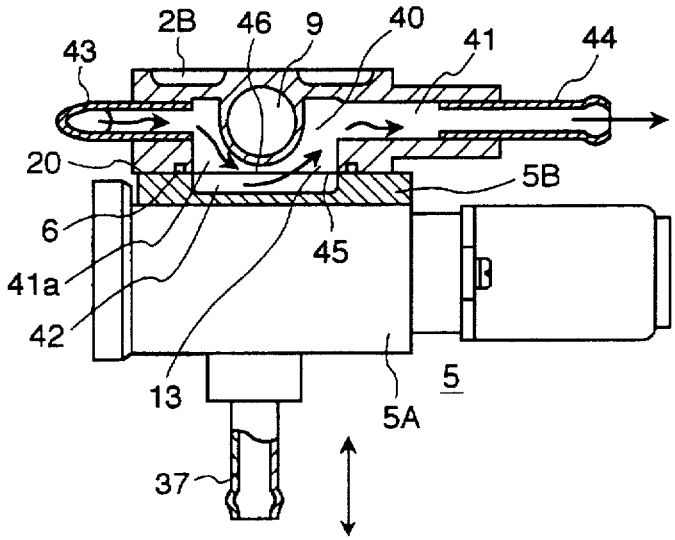
FIG. 3 shows a sectional view in a line III—III of the FIG. 1.

In FIGS. 1 to 3, numeral 1 shows an air flow rate control valve which is a main frame of the air flow rate control apparatus, the air flow rate control valve 1 has a throttle body 2 disposed laterally, a boa 3 constituting a part of 1 part of an inspiration passage is formed in the throttle body 2, and a throttle valve 4 is turnably supported in the boa 3.

Further, a proportional type ISC 5 (idle revolution speed control apparatus) is installed under the throttle body 2 disposed laterally, and the boa 3 of throttle body 2 is connected to an upper flow side of the throttle body 2 by this ISC 5 through the throttle valve 4 of the throttle body 2 and an air flow rate is controlled according to a condition of the engine.

Figure 4:
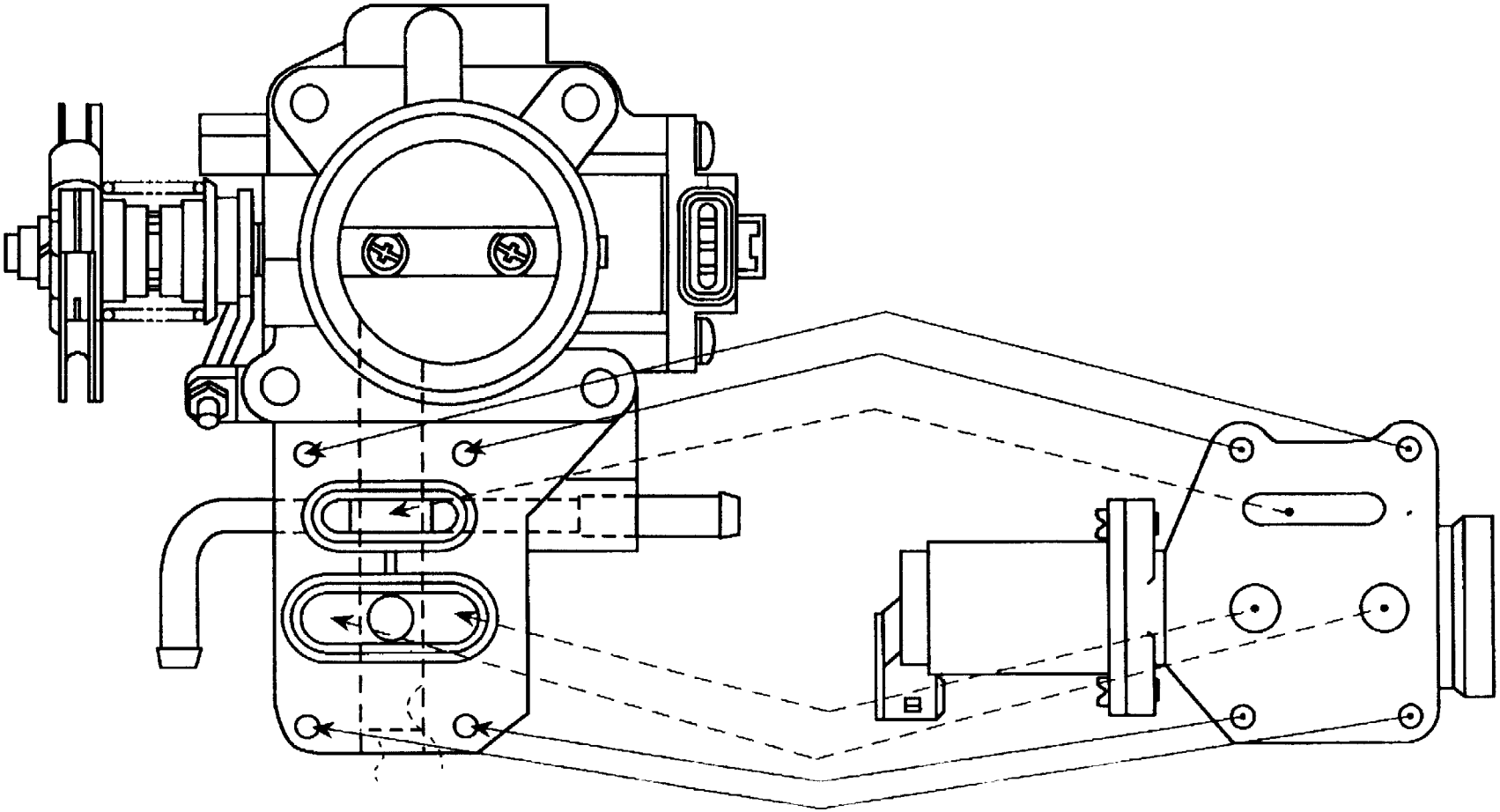
FIG. 4 is a view which shows an exploded view of the throttle body and the ISC valve of the air flow rate control apparatus shown in FIG. 1.
Figure 5:
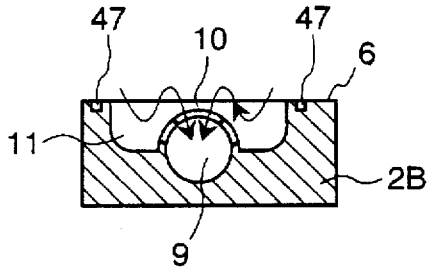
FIG. 5 is a sectional view in a V—V line of FIG. 4.

The throttle body 2 have a cylinder portion 2A forming the boa 3 and a base portion 2B having a jointing surface 6 installed the ISC valve 5 hanging down from the cylinder portion 2A, and a tubular type perpendicular cavity 9 having a bottom closed by a seal plug 7 and an upper part connected to the boa 3 of the cylinder portion 2A with an aperture part 8 is formed in the base department 2B. An aperture part 10 is formed to a side of the perpendicular cavity 9, and the aperture part 10 is opened to an ellipse air passage 11 formed so as to be opened to the jointing surface 6 of the base department 2B at the aperture part 11*a* as shown in FIGS. 4 and 5.

Here, the bottom of the perpendicular cavity 9 (top face of the plug 7) is lower than the bottom end of the aperture part 10, an upper part of the perpendicular cavity 9 constitutes the air passage 9A and a lower part constitutes a water pool portion 9B. Volume of the water pool portion 9B may be adjusted by changing length of the seal plug 7.

Figure 6:
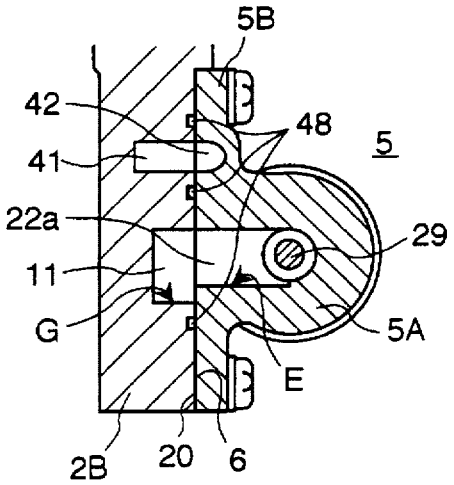
FIG. 6 is a sectional view in a V—V line of FIG. 1.
Figure 7:
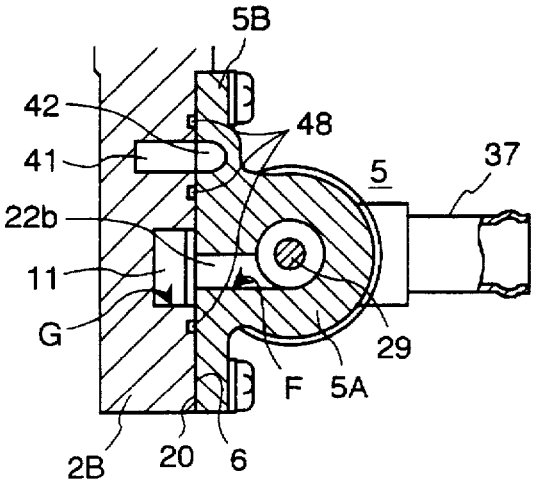
FIG. 7 is a sectional drawing in a VII—VII line of FIG. 1.

The proportional type ISC valve 5 has a valve main frame 5A to have measuring part (explained later) and the jointing surface 20 to grapple with the jointing surface 6 of the base part 2B of the throttle body 2, has an installation flange part 5B fixed by a screw 21, and air-outlet passages 22*a*, 22*b* opened to the aperture department 23*a*, 23*b* in the jointing surface 20 are formed from the measuring part of the valve main frame 5A to the jointing surface 20 of the installation flange department 5B as shown in FIGS. 6 and 7, and the bottom of the section of the air-outlet passage 22*a*, 22*b* becomes lower than or the same level as the bottom end of each measuring part(explained later).

Figure 8:
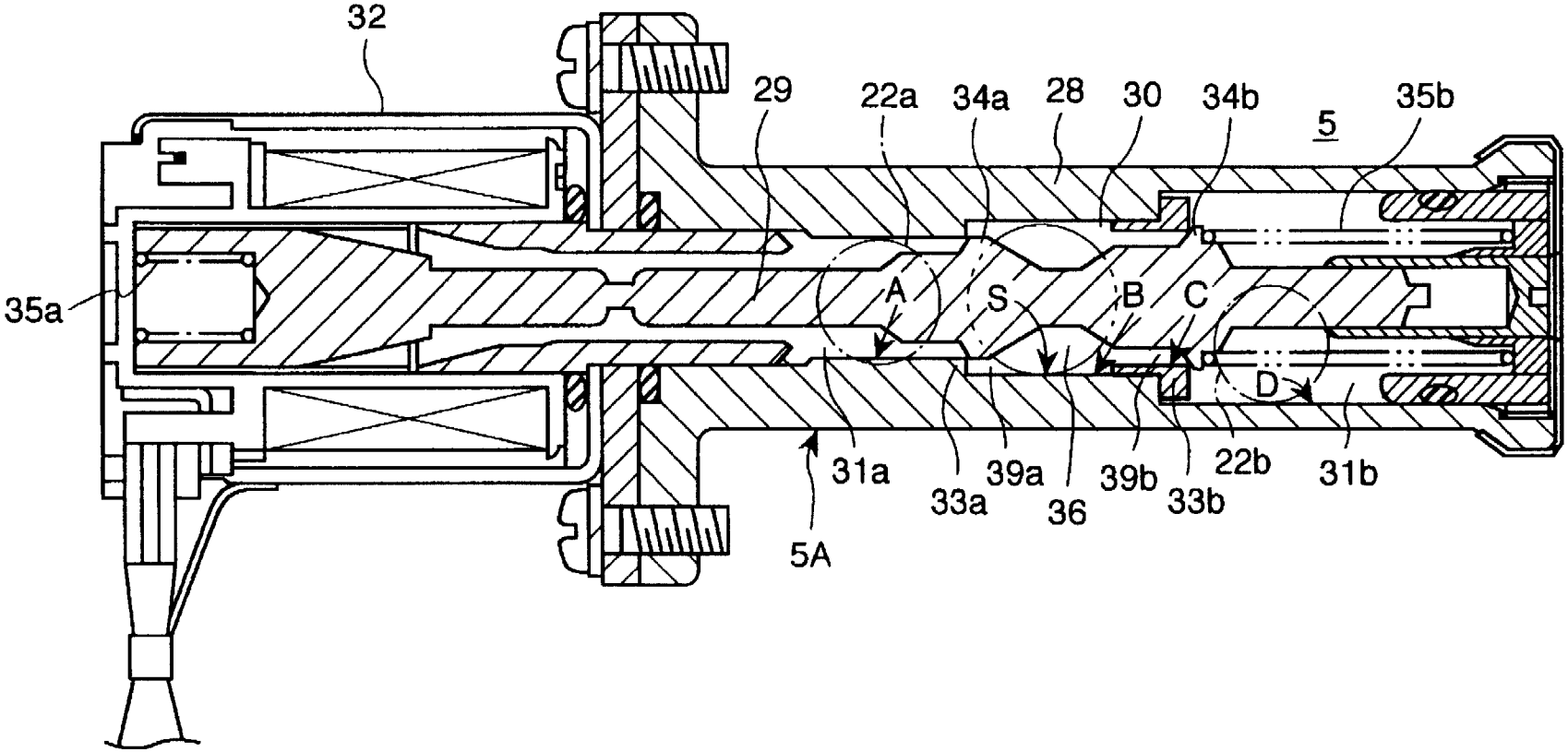
FIG. 8 is a longitudinal section of the ISC valve of the air flow rate control apparatus shown in FIG. 7 is a sectional drawing in FIG. 1.

The valve main frame 5A of the proportional type ISC valve 5 is shown in FIG. 8 in detail. The valve main frame 5A is constructed with the valve housing 28, a valve shaft 29 that is movable towards a shaft direction in the valve housing 28 and the proportional type electric solenoid 32 to drive the valve shaft 29. The valve housing 28 has an inside valve chamber 30 and two outside valve chambers 31*a*, 31*b* and, valve seats 33*a*, 33*b* are respectively provided between the inside valve chamber 30 and the outside valve chamber 31*a* and between the inside valve chamber 30 and the outside valve chamber 31*b*, and the valve bodies 34*a*, 34*b* are provided in a position meeting the valve seats 33*a*, 33*b* of the valve shaft 29, and measuring parts 39*a*, 39*b* are respectively constituted with the valve seats 33*a*, 33*b* and the valve bodies 34*a*, 34*b*. And in both end points of the valve shaft 29, springs 35*a*, 35*b* which keep the valve shaft 29 in a neutral position are provided.

Furthermore, in a part of the inside valve chamber 30 of valve housing 28, an air-inlet passage 36 is formed, an inlet pipe 37 is inserted so as to be fixed as shown in FIG. 2 in the air-inlet passage 36, and the air-outlet passages 22*a*, 22*b* mentioned above are formed in the part of the outside valve chambers 31*a*, 31*b* of the valve housing 28.

The ISC valve 5 is operated by a duty control of proportional type electric solenoid 32, and a clearance of the measuring part 39*a*, 39*b* consisting of the valve seats 33*a*, 33*b* and the valve body 34*a*, 34*b* is changed by moving the valve shaft 29 to the shaft direction according to the electromagnetic force of the proportional type electric solenoid 32, thereby a volume of an air flowing through the measuring part 39*a*, 39*b* is controlled. The measuring part 39*a*, 39*b* of the ISC valve is usually kept to hold the clearance inconsiderably by a setting of the spring 35*a*, 35*b* in order to prevent adhesion of carbon etc. blown up from the engine side when the engine stops.

An inlet pipe 37 is connected to an upper side of the throttle body 2, that is, the air cleaner in this embodiment. Futher, the inlet pipe 37 may be connected to the upper side of throttle valve 4 of the boa 3 of the throttle body 2.

Here, the bottom end S (lower part of the passage section) of air-inlet passage 36 is disposed at the same level as a lower surface B of the inside valve chamber 30 as shown in FIGS. 2 and 8.

Further, the air-outlet passage 22*a*, 22*b* is disposed towards more underneath than an axial center of the measuring part 39*a*, 39*b*, thereby, the bottom end E (passage section bottom) of the air-outlet passage 22*a* is disposed in a lower level than a lower surface A of the outside valve chamber 31*a* as shown in FIGS. 6 and 8. The passage section bottom E of the air-outlet passage 22*a* is lower than the bottom end C (lower face of the valve seat 33*b*) of the measuring part 39*a* and the passage section bottom F of the air-outlet passage 22*b* is lower than the bottom end A (lower surface of the valve seat 33*a*) of the measuring part 39*b*.

Further, the side aperture part 10 of the perpendicular cavity 9 installed on base part 2B of the throttle body 2, and the bottom end G of the air passage 11 are disposed in a lower level than bottom ends E, F of the air-outlet passage 22*a*, 22*b* as shown in FIGS. 2, 6 and 7.

As explained above, by setting levels to every parts of the air passage, a water pool portion 9B having a closed bottom disposed in a lower position than the measuring part 39*a*, 39*b* and an upper part opened up in the air passage 9A in the airpassage 22*a*, 22*b*, 11, 10, 9A from the measuring part 3, 39*a*, 39*b* of the proportional type ISC valve 5 to the throttle body 2 is formed, and the air passage parts 22*a*, 22*b*, 11, 10 disposed between the measuring part 39*a*, 39*b* and the water pool portion 9B serve as a drain passage through which water in the measuring part 39*a*, 39*b* falls to the water pool portion 9B.

In the upper part of the air passage 11 from an installation flange part 5B of the ISC valve 5 to the base part 2B of the throttle body 2, a hot water passage 40 for passing through both of the base part 2B and the installation flange part 5B is formed as shown in FIG. 3.

Hot water passage 40 comprises a passage part 41 formed with a part 41 a which detours around the perpendicular cavity 9 on the base part 2B of the throttle body 2, a passage part 42 formed by an installation flange part 5B of the ISC valve 5, an inlet water pipe 43 inserted and fixed on one end side of passage part 41, and the outlet water pipe 44 inserted and fixed in the another end side of the passage part 41.

Said hot water passage 40 is formed with a concave part in which the part 41*a* detouring around the perpendicular cavity 9 of the passage part 41 is opened at an aperture part 45 to a jointing surface 6 of the base part 2B and the passage part 42 is opened at an aperture part 46 to a jointing surface 20 of the installation flange department 5B.

The detour part 41*a* and the passage part 42 are opened to both of the jointing surface 6 of the base part 2B and the jointing surface 20 of the installation flange part 5B, and forms a water room connected to both of the base part 2B and the installation flange part 5B.

In the jointing surfaces 6, 20, the aperture parts 23*a*, 23*b*, 11*a* of the air passages 22*a*, 22*b*, 11 and the aperture parts 45, 46 of the passage parts 41*a*, 42 of the hot water passage 40 are sealed by a double ring type oil seal packing 48 mounted in a double piston-ring groove 47 formed in the jointing surface 6 of the base part 2B as shown in FIG. 4.

Here, the oil seal packing 48 is compressed by tightening a screw 21 for fixing the installation flange department 5B on the base part 2B, and the jointing surface 6 of the base part 2B and the jointing surface 20 of the installation flange part 5B come into contact with a metal.

The hot water is compressed so as to be taken in an air flow rate control apparatus from a radiator which is not shown in the figure through the inlet water pipe 43.

The hot water passes both of the base part 2B of the throttle body 2 and the installation flange part 5B of the ISC valve 5 through the water rooms 41*a*, 42, and the hot water lost heat thereof is returned into the engine side from the outlet water pipe 44.

An operaton of the air flow rate control apparatus in an embodiment of the present invention will be explained in the next.

At first, when the engine is started, absorbing negative pressure of the engine is transmitted to the down stream of the throttle valve 4 of the throttle body 2 and air flows in from a previously provided clearance on a wall surface of the boa 3 and the throttle valve 4.

But this air flow rate is one part of total amount which is necessary in the engine starting, and the remaining flow rate flows in from the ISC valve 5, thereby both of the air flow rates improve a starting mixture ratio of the engine.

Figure 9:
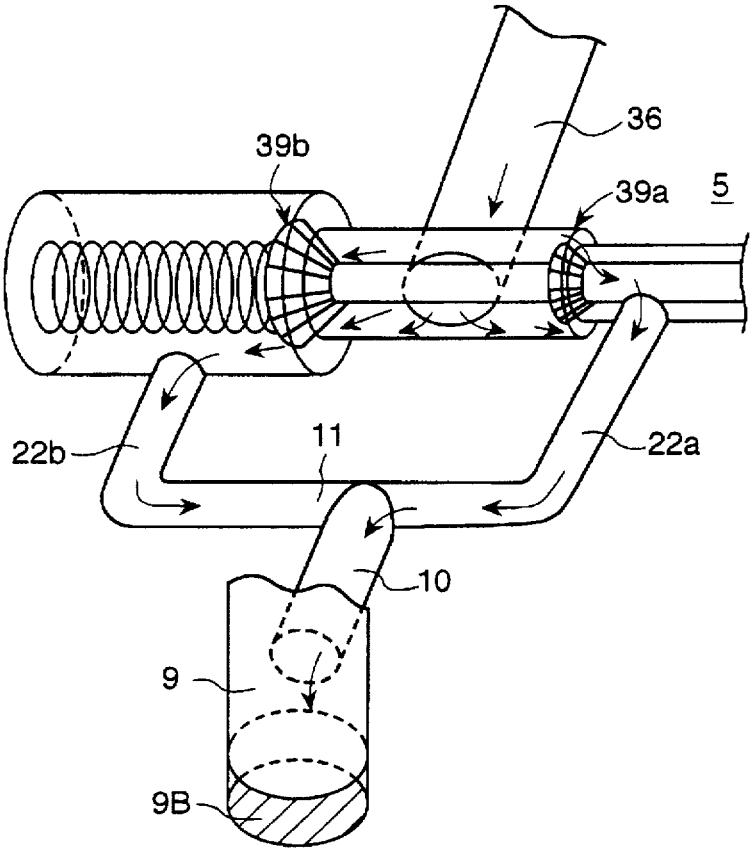
FIG. 9 is a piping diagram which shows a layout of all the passage of the air flow rate control apparatus shown in FIG. 1.

Air flow in the ISC valve 5 will be explained by using FIG. 9.

When the absorbing negative pressure in the engine is added to the perpendicular cavity 9 of the base part 2B of the throttle body 2 through the aperture part 8, the negative pressure is transmitted to the air-outlet slit passage 22*a*, 22*b* of the ISC valve 5 and further transmitted to the measuring parts 39*a*, 39*b*.

By this negative pressure, from an air cleaner in a case that the entry pipe 37 is connected to the air cleaner, and from inside of the throttle valve 4 in a case that the inlet pipe 37 is connected to inside of the throttle valve 4 of the boa 3 of the throttle body 2, air flow rate according to the clearance of the measuring part 39*a*, 39*b* which is determined according to duty control of the proportional type electric solenoid 32 flows into the outlet passage 22*a*, 22*b* and the perpendicular cavity 9 through the inlet passage 36, and further flows into the boa 3 of the throttle body 2.

As explained above, the air flow rate control apparatus keeps the engine rotated by the air amount flowing in from the clearance between the throttle valve 4 and a wall surface of the boa 3, and by the air amount measured with the measuring part 39*a*, 39*b* of the ISC valve 5.

That is, by both of the air amounts in early stage, the engine starting becomes easy, and when either of the flow rate stops, the starting of the engine becomes difficult or starting failure of the engine happens. In particular ISC valve 5 is reasonably controlled by a signal from an intake air temperature sensor or a water temperature sensor (or a switch) so as to provide a predetermined air amount without any relation to an accerelator operation, and the air amount being necessary for the engine is provided.

Accordingly, in engine starting of early stage and in maintaining the suitable engine revolution speed, the ISC valve 5 hold a big role. On this account, it is needed for the measuring part 39*a*, 39*b* of the ISC valve 5 to be in a condition which can always work.

An icing problem in the measuring part 39*a*, 39*b* of the ISC valve 5 caused by a water pool in the present invention will be explained. There are two cases which water pools in the ISC valve 5. The first case relates to a water immersion from external. For example when steam washing of the engine is taken place, water may enter in an air cleaners, such the water may be accumulated in the measuring part 39*a*, 39*b* of the ISC valve 5 through the inlet pipe 37 and inlet passage 36. The second case relates to a condensation which occurres in the ISC valve 5 or inner wall of boa 3 of the throttle body 2 by a change of temperature and air moisture of fresh air. In particular, the inner pipe arrangement connected to the inlet pipe 37 in order to introduce the air into the ISC valve 5 is very long, when the inside pipe arrangement is installed on a higher position than the inlet pipe 37, the condensation which generated in the pipe arrangement is pooled as a water drop in the measuring part 39*a*, 39*b* of the ISC valve 5. As the dew condensation occurs in the inner wall of the boa 3 of the throttle body 2, condensations are accumulated as water drops in the measuring part 39*a*, 39*b* of the ISC valve 5 arranged just under the throttle body 2.

In any case of them, when the water pooled in the measuring part 39*a*, 39*b* is pretty much, the temperature goes down suddenly and the measuring parts 39*a*, 39*b* are buried in the water, the measuring parts 39*a*, 39*b* are freezed.

In the case the quantity of water is very little and slightly comes in contact with the bottom end of the measuring part 39*a*, 39*b*, as there exists the small gap in the measuring parts 39*a*, 39*b* as explained above, the water comes in this gap by capillary phenomenon, the measuring parts 39*a*, 39*b* are frozen in the same way. In these case, the condensations stick to the valve seat parts 33*a*, 33*b* of the measuring part 39*a*, 39*b*, however the adherence by the freezing doesn't occur.

Embodients of two cases for preventing the icing by water droplets in the present invention will be explained in the next.

At first, the case that water invaded from air cleaners etc. will be explained. In this case, the water entered from the inlet passage 36 by setting of level of the air-outlet passages 22*a*, 22*b* stated above is pooled in B side surface of an inlet side valve chamber 30 once.

According to water increasing, the water drops falls down into D side surface of an outlet side valve chamber 31*b* and F side surface of the air-outlet passage 22*b* over C side surface of valve seat 33*b*. The water falles from F side surface furthermore to the bottom end G of the air passage 11 and the aperture part 10, and is drained to the water pooll portion 9B formed under the perpendicular cavity 9.

Here, the water collected in water pool part 9B is processed as that the water is promptly absorbed to the engine through the boa 3 of the throttle body 2 by the absorbing negative pressure of the engine in the engine starting, and the water doesn't remain in the water pool part 9B at all after the engine starting. This is confirmed with a visual model on a desk test and the water collected in the water pool part 9B is absorbed with air even in the case of low boost of cranking in engine starting.

The amount of the water pool part 9B of perpendicular cavity 9 depends on a maximum entering volume of the water which can be stored in the water pool part from the engine or the vehicle and is adjusted by changing overall length of the seal plug 7.

Next, the case of dew condensation will be explained. When water drops are collected by the dew condensation in A side surface of the outlet side valve chamber 31*a* arranged in the same plane with the valve seat 33*a* of the measuring part 39*a*, the water falls into E side surface of the air-outlet passage 22*a*, furthermore falls into the bottom end G of the air passage 11 and the aperture part 10, and are drained into the water pool portion 9B formed under the perpendicular cavity 9.

As the water drops by the condensations which occurred at inside pipe arrangements etc. are collected to the B side surface of the inlet side valve chamber 30, the water drops are fallen to the C side surface of the valve seat 33*b*, the D side surface of the outlet side valve chamber 31*b*, and the F side of the air-outlet passage 22*b*, and further to the bottom end G of the air passage 11 and the aperture part 10, and are drained into the water pool portion 9B in the same way as the case that the water invades in to the air cleaners.

The measuring part 39*a*, 39*b* may be prevented from the icing caused by the water pool as stated above.

Furthermore, even if after the engine starting, the some parts led to the air-outlet passages 22*a*, 22*b* in a certain condition, may be frozen instantly, the measuring parts 39*a*, 39*b* are frozen too and the air from the ISC valve 5 becomes in a state as to be intercepted. It causes, for example, a suddon deccelerating if the icing is raised when accelerating the car so as to stop the engine.

In the embodiment of the present invention, as both of the throttle body 2 and the ISC valve 5 are warmed simultaneously in a passage 40 for the hot water passing through both of the throttle body 2 and the ISC valve 5, the water temperature goes up after the engine starting, and both of the water pool part 9B of the base part 2B and the air-outlet passages 22*a*, 22*b* of the ISC valve 5 are heated simultaneously, thereby the icing is prevented.

Further, as a water chamber 41*a* of the hot water passage 40, the air-outlet passage 22*a*, 22*b*, and the air passage 11 are opened to the same jointing surfaces 6, 20, easy isolation of both passages and air tightness of the air-outlet passages 22*a*, 22*b*, and the air passage 11 are secured by using an oil seal packing 48 of heteromorphy double ring type.

Furthermore, as the oil seal packing 48 is compressed by tightening the screw 21, and the jointing surface 6 of the base part 2B and the jointing surface 20 of the installation flange part 5B1 come in metal contact, more more heating up becomes effective by mixing both of the donducted heats.

According to the embodiment of the present invention, in the air flow rate control apparatus having the ISC valve 5 under the throttle body 2, the water pool portion 9B is provided in the air passage reaching the boa 3 of the throttle body 2 from the ISC valve 5, and the air-outlet passages 22*a*, 22*b* etc. from the ISC valve 5 to the water pool portion 9B are served as the drain passage where water of the measuring parts 29*a*, 29*b* fall into the water pool portion 9B, thereby the measuring parts 39*a*, 39*b* of the ISC valve 5 is prevented from freezing in the chilly time and an appropriate engine starting is secured.

Furthermore, as a hot water passage 40 to simultaneously heat both of the throttle body 2 and the ISC valve 5 is provided, the measuring parts 39*a*, 39*b* are prevented from the icing even if after the engine starting and an appropriate road holding of the car is secured.

Furthermore, as the water collected in the water pool portion 9B in while the engine stops is absorbed from the boa 3 of the throttle body 2 into the engine by utilizing a cranking negative pressure in the engine starting, the water of the water pool portion 9B is always surely drained without cloging up the passage with carbon in blow by gas and high reliability in freezing protection is secured.

Furthermore, the air passage serves as the drain passage, any special passage isn't provided for the drain from the water pool portion 9B and construction thereof becomes extremely simple, too.

As any special passage for the drain of the water pool portion 9B is not needed, the ISC valve 5 may be installed under the throttle body 2 in spite of no difference in height between the ISC valve 5 and the engine, and layout design for the engine room becomes easy.

In cleaning of the engine room, the ISC valve 5 should be designed so as not to be entered by the water, and layout design becomes easy in this point.

Furthermore, the perpendicular cavity 9 as a part of the air passage is provided in the base part 2B, a bottom part of the perpendicular cavity 9 is installed low than the measuring parts 39*a*, 39*b* and the water pool portion 9B is formed under the perpendicular cavity 9, and parts 41*a*, 42 located in a position which belongs to both of the jointing surface 6 of the base department 2B and the jointing surface 20 of the installation flange part 5B in hot water passage 40 are provided.

Thereby, as the hot water passage 40 goes through both of the base part 2B and the ISC valve 5, the water pool portion 9B is provided with a simple constitution without changing the construction from a usual device and both of the throttle body 2 and ISC valve 5 may be warmed simultaneously.

The second embodiment of the present invention will be explained by using FIGS. 10 to 12. In the drawings, same codes in FIGS. 10 to 12 show same members in FIGS. 1 to 9.

Figure 10:
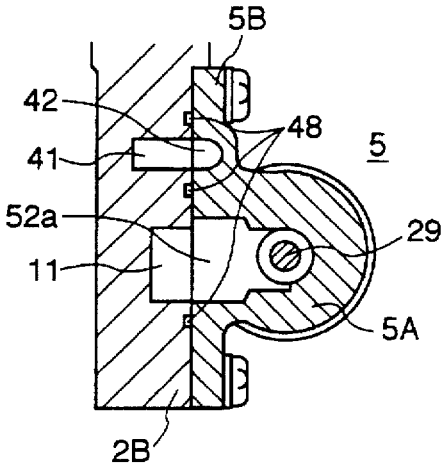
FIG. 10 is a sectional view of the air flow rate control apparatus as a second embodiment in the present invention in the same way as FIG. 6.
Figure 11:
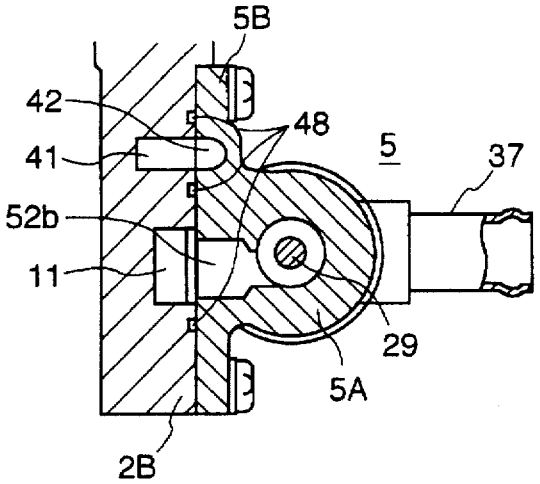
FIG. 11 is a sectional view of the air flow rate control apparatus as the second embodiment in the present invention in the same way as FIG. 7.
Figure 12:
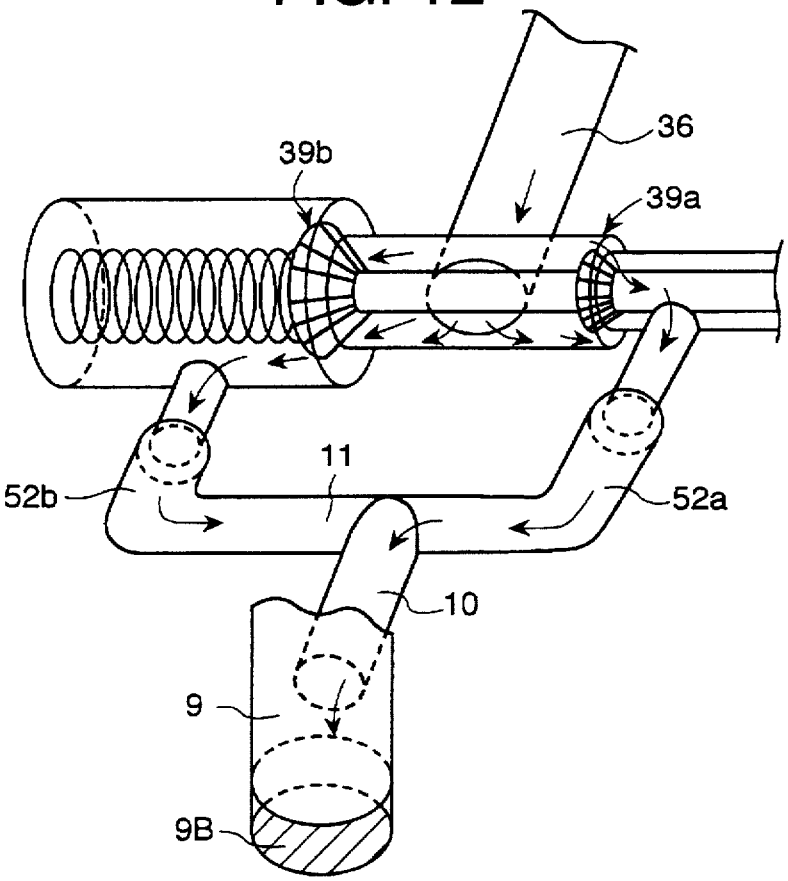
FIG. 12 is a sectional view of the air flow rate control apparatus as the second embodiment in the present invention in the same way as FIG. 9.
Figure 13:
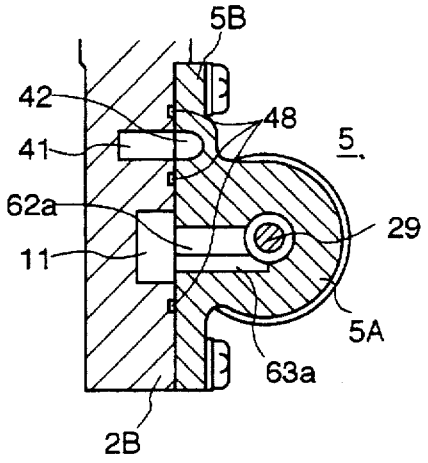
FIG. 13 is a sectional view of the air flow rate control apparatus as a third embodiment in the present invention in the same way as FIG. 6.
Figure 14:
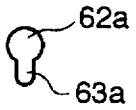
FIG. 14 is a sectional view of an air-outlet slit passage shown in FIG. 13.
Figure 15:
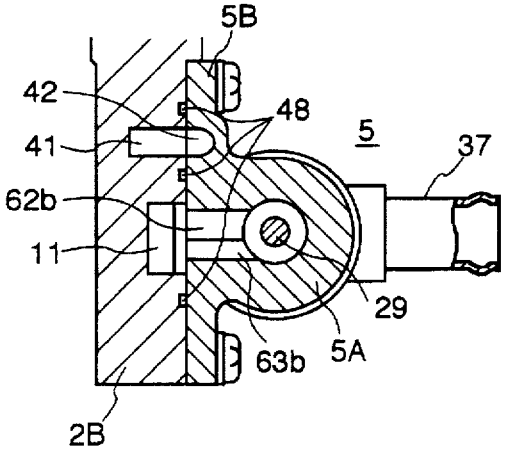
FIG. 15 is a sectional view of the air flow rate control apparatus as the third embodiment in the present invention in the same way as FIG. 7.
Figure 16:
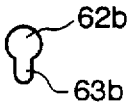
FIG. 16 is a sectional view of air-outlet slit corridor shown in FIG. 15 is been.

In the air flow rate control apparatus of this embodiment of the present invention shown in FIGS. 10 to 12, the air-outlet passages 52*a*, 52*b* of the ISC valve 5 is declined downwards from an axial center of the measuring part 39*a*, 39*b* and it is the same as the first embodiment.

However, in order to let the water drained into the water pool portion 9B positively, the air-outlet passages 52*a*, 52*b* are fromed to be thick in the way thereof so as to provide a stepwise configuration.

According to this embodiment, the water easily drops in the air-outlet passages 52*a*, 52*b*, it becomes more effective to protec the freezing of the ISC valve 5.

The third embodiment of the present invention will be explained by Using FIGS. 13 to 16. Same codes in FIGS. 13 to 16 show same members in FIGS. 1 to 9.

In the air flow rate control apparatus of this embodiment of the present invention shown in FIGS. 13 to 16, the air-outlet passages 62*a*, 62*b* is not inclined from an axial center of the measuring part 39*a*, 39*b* and grooves 63*a*, 63*b* only used as the drain are provided under the air-outlet passages 62*a*, 62*b*.

Thereby, the section bottom of the air passage constituted with the air-outlet passages 62, 62*b* and the grooves 63*a*, 63*b* is arranged lower than the bottom end of the measuring parts 39*a*, 39*b*.

Effect same as in the first embodient is provided by this third embodiment.

Figure 17:
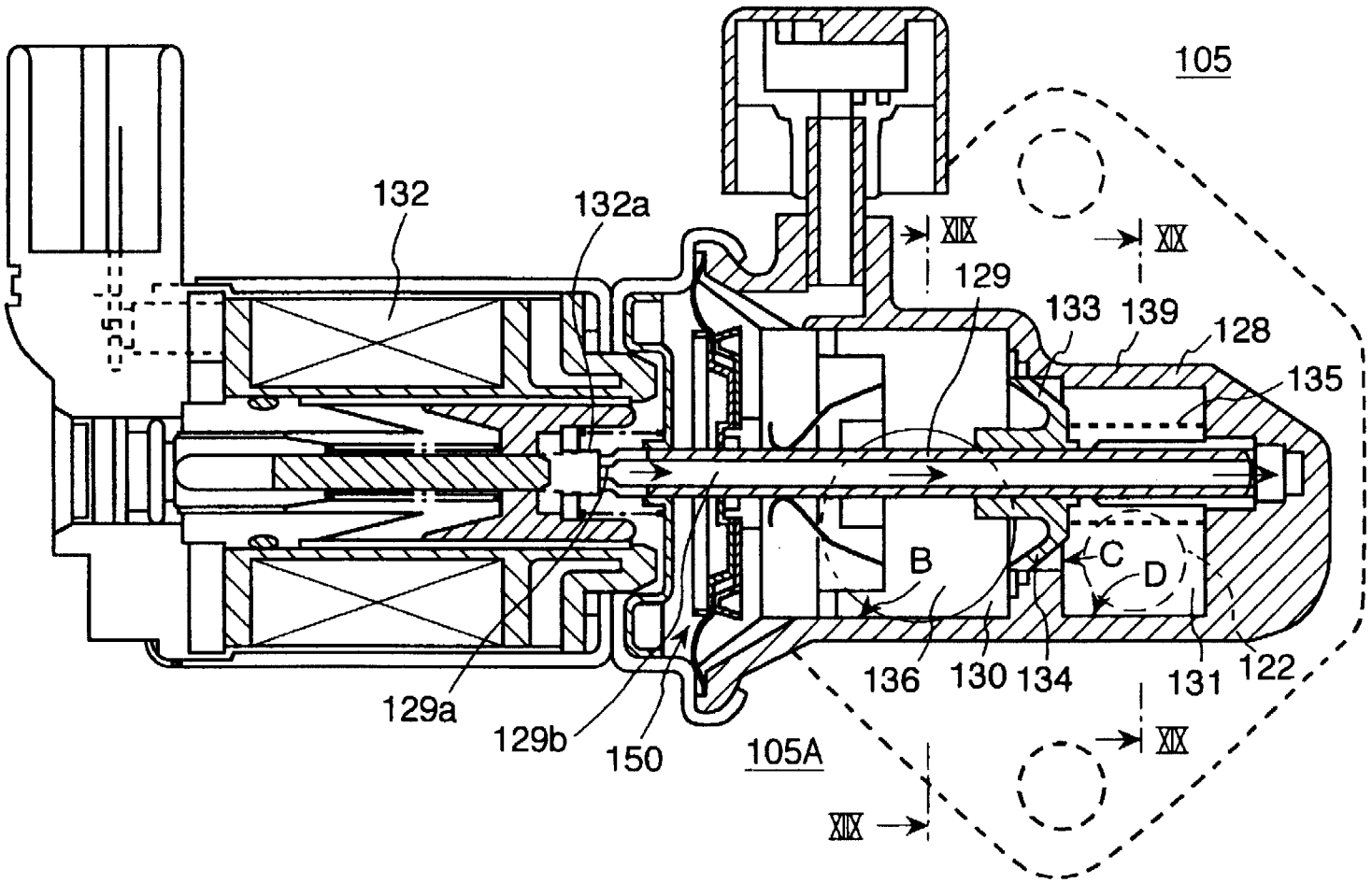
FIG. 17 is a longitudinal section of the ISC valve of the air flow rate control apparatus as a fourth embodiment in the present invention.
Figure 18:
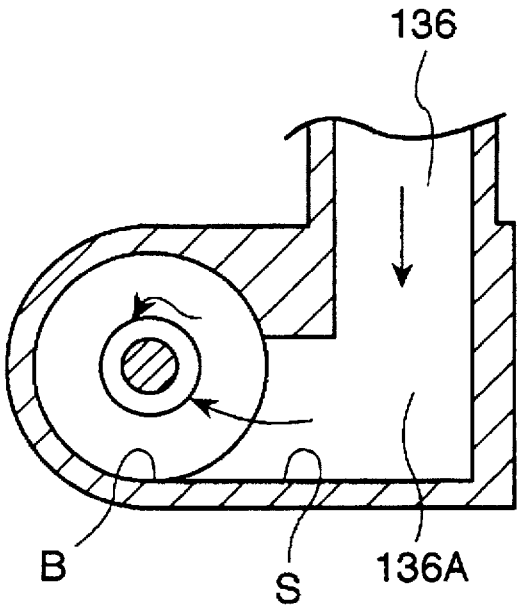
FIG. 18 is a sectional view in a XIIV—XIIX line of FIG. 17.
Figure 19:
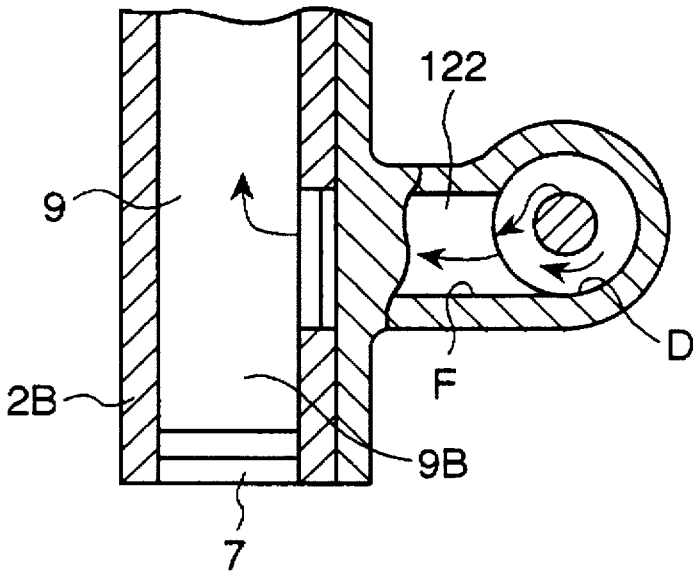
FIG. 19 is a sectional view in a XIX—XIX line of FIG. 17.

The forth embodiment of the present invention will be explained by Using FIGS. 17 to 19. Same codes in FIGS. 17 to 19 show same members in FIGS. 1 to 9. This embodiment of the present invention relates to an air flow rate control apparatus having linear type ISC valve used in a full-size vehicle.

As shown in FIG. 17, the linear type ISC valve 105 has a valve main frame 105A, the valve main frame 105A is constructed with a valve housing 128, a valve shaft 129 which is movable to shaft direction in the valve housing 128, a proportional type electric solenoid 132 for actuating valve shaft 129, and a negative pressure diaphragm mechanism 150.

The valve housing 128 has an inlet side valve chamber 130 and outlet side valve chamber 131, a valve seat 133 to have level C which is higher than lower side surface B of the inlet side valve chamber 130 and lower the side surface D of the outlet side valve chamber 131 are provided between the inlet side valve chamber 130 and the outlet side valve chamber 131, a valve body 134 are provided on a location meeting the valve seat 133 of the valve shaft 129, and the measuring part 139 is constituted with the valve seat 133 and the valve body 134.

In a right side end of the valve shaft 129 as shown in the figure, a spring 135 for moving the valve body 134 so as to be opened is provided.

In a part of the inlet valve chamber 130 of the valve housing 128, an air-inlet passage 136 connected to an upper flow side of the throttle body (it isn't shown in the figure) is formed, and an air-outlet passage 122 is formed in a part of the outlet valve chamber 131 of the valve housing 128.

The ISC valve 105 is actuated based on a duty control of the proportional type electric solenoid 132. According to an electromagnetic force of the proportional type electric solenoid 132, a moving element 132*a* moves, end aperture 129*a* of the valve shaft 129 opens, and an air in the diaphragm mechanism 150 is absorbed from the air-outlet passage 122 by the negative pressure of the engine through the negative pressure passage 129*b* in the valve shaft 129 as shown by an arrow in the figure.

The clearance of the measuring part 139 constituted with the valve seat 133 and the valve body 134 is changed by moving the valve shaft 129 into the shaft direction, thereby air capacity flowing through the measuring part 139 is controlled. The measuring part 139 of the ISC valve is usually kept a state closed by a power of the diaphragm mechanism 150.

Here, the part 136 A led to inlet side valve chamber 130 of the air-inlet passage 136 is inclinedd to downwards more than axial center of the measuring part 139, and the bottom end S (passage section bottom part) of the air-inlet passage 136A is in a same level as the lower surface B of the inlet side valve chamber 130 as shown in FIG. 18 and is in a lower level than the bottom end C (lower surface of the valve seat 133) of the measuring part 139.

The air-outlet passage 122 is inclined from the axial center of the measuring part 139, too and the bottom end F (passage section bottom part) of the air-outlet passage 122 is in a same level as the lower surface D of the outlet side valve chamber 131 as shown in FIG. 19 and is in a lower level than the bottom end C (lower surface of the valve seat 133) of the measuring part 139.

The construction of the base part 2B of the throttle body is substantially the same as in the first embodiment and the lower part of the perpendicular cavity 9 where the air-outlet passage 122 opens forms the water pool portion 9B.

As stated above in this embodiment of the present invention, in the ISC valve 105 in which the level C of the measuring part 139 is higher than the lower side surface B of the inlet side valve chamber 130 and the lower side surface D of the outlet side valve chamber 131, the bottom end S (passage section lower part) of the air-inlet passage 136A is provided in the same level as the lower surface B of the inlet side valve chamber 130.

Thereby, the air-inlet passage part 136A forms the water pool portion in the entrance side with the inlet side valve chamber 130, the water which is invaded from the upper flow side of the air-inlet passage 136 is once pooled in this water pool portion, and the measuring part 139 is prevented from being sticked to the water till the water level of the water pool portion rises in the level C of the measuring part 139.

When the water level of the water pool portion exceeds the level C of the measuring part 139, the water falls in the outlet side valve chamber 131, and after that, the water falls into the water pool portion 9B of the throttle body base part 2B through the air-outlet passage 122 in the same way as in the first embodiment.

The hot water passage may be provided in the forth embodiment in the same way as in the first embodiment.

In the construction of this embodiment, the water is collected in the water pool portion of the air-inlet passage part 136A up to the C surface of the measuring part 139, and then a lower part of the measuring part 139 gets wet a little. However, even if it is assumed that it freezes, as absorption power of the electric solenoid 132 is so strong and the negative pressure diaphragm mechanism 150 is provided, any malfunction does not arise.

In a air flow control apparatus having a linear type ISC valve 105, effect same as in the first embodient is provided by this third embodiment.

Figure 20:
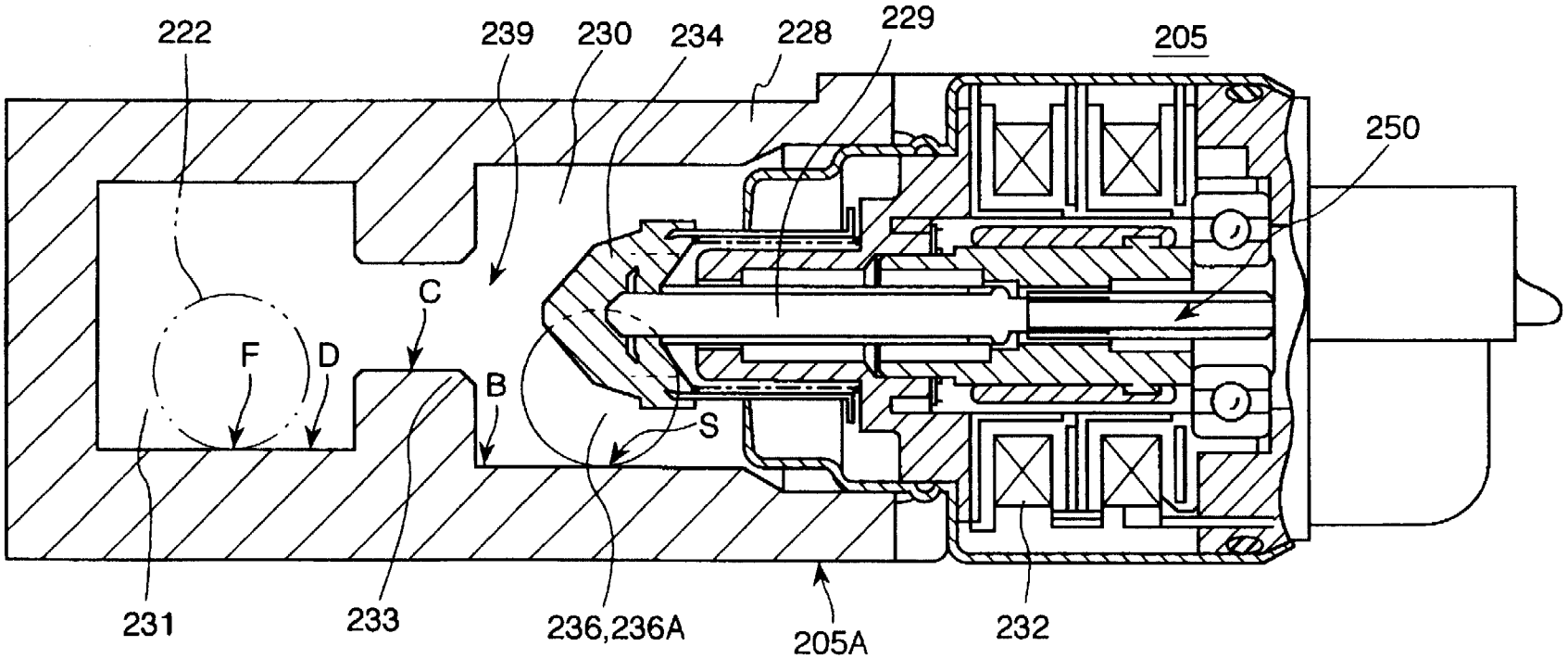
FIG. 20 is a longitudinal section of the ISC valve of the air flow rate control apparatus as a fifth embodiment in the present invention.

The fifth embodiment of the present invention will be explained by using FIG. 20. Same codes in FIG. 20 show same members in FIGS. 1 to 9. This embodiment relates to an air flow rate control apparatus installing the ISC valve having a stepping motor.

In FIG. 20, the ISC valve 205 in this embodiment has a valve main frame 205A, and the valve main frame 205A has a valve housing 228, a valve shaft 229 that is movable in the valve housing 228 to a shaft direction thereof, a stepping motor 232 to actuate the valve shaft 229, and a screw mechanism 250 to convert a revolution of the stepping motor 232 into a linear-motion of the valve shaft 229.

The valve housing 228 has an inlet side pillar valve chamber 230 and an outlet side valve chamber 231, a valve seat 233 having a high level C which is higher than a lower surface B of the inlet side valve chamber 230 and a lower surface D of the outlet side valve chamber 231 are provided between the inlet side valve chamber 230 and the outlet side valve chamber 231, a valve body 234 is provided in a location meeting the valve seat 233 of the valve shaft 229, and the measuring part 239 is constituted with the valve seat 233 and valve body 234. An air-inlet passage 236 connected to the upper flow side of the throttle body (not shown in the drawings) is formed in the inlet valve chamber 230 of valve housing 228 and an air-outlet passage 222 is formed in the outlet valve chamber 231 of the valve housing 228.

The ISC valve 205 is actuated by a revolution speed control of the stepping motor 232. When stepping motor 232 turns, the revolution is converted into the linear-motion of the valve shaft 229 by the screw mechanism 250, and clearance of the measuring part 239 having valve the seat 233 and the valve body 234 is controlled by moving the valve shaft 229 according to the revolution speed of the stepping motor 232, thereby an amount of the air flowing through the measuring part 239 is controlled. Here, when the engine stops, the measuring part 239 of the ISC valve are usually kept in an opened state.

The construction of a part 236 A led to the inlet side valve chamber 230 of the air-inlet passage 236 and the air-outlet passage 122 is substantially the same as the fourth embodiment as shown in FIGS. 18 and 19. The bottom end S (passage section bottom part) of the air-inlet passage 236A is in a same level as the lower surface B of the inlet side valve chamber 230, and is in a lower level than the bottom end C (lower surface of the valve seat 233) of the measuring part 239, and the bottom end F (passage section bottom part) of the air-outlet passage 222 is in a same level as the lower surface D of the outlet side valve chamber 231 and is in a lower level than the bottom end C (lower surface of the valve seat 233) of the measuring part 139. The air-outlet passage 222 is opened to the perpendicular cavity 9 having the water pool portion 9B (refer FIG. 19).

In ISC valve 205 having the stepping motor 232, when the measuring part 239 is completely set in the water, the valve body 234 may not move because of freezing thereof, In this embodiment, the air-inlet passage 236A forms a water pool portion in the entrance side with the inlet side valve chamber 230, thereby, the water stickes to the measuring part 239 is controlled in minimum, simultaneously as the water flown down to the outlet side valve chamber 232 is fallen into the water pool portion 9B of throttle body base part 2B through the air-outlet passage 222, the icing in the measuring part may be prevented in the same way as in the first embodiment.

In this embodiment, the lower part of the measuring part 239 gets wet inconsiderably in the same way as in the forth embodiment. However, as the driving torque of the stepping motor is pretty large, any malfunction does not happen.

Figure 21:
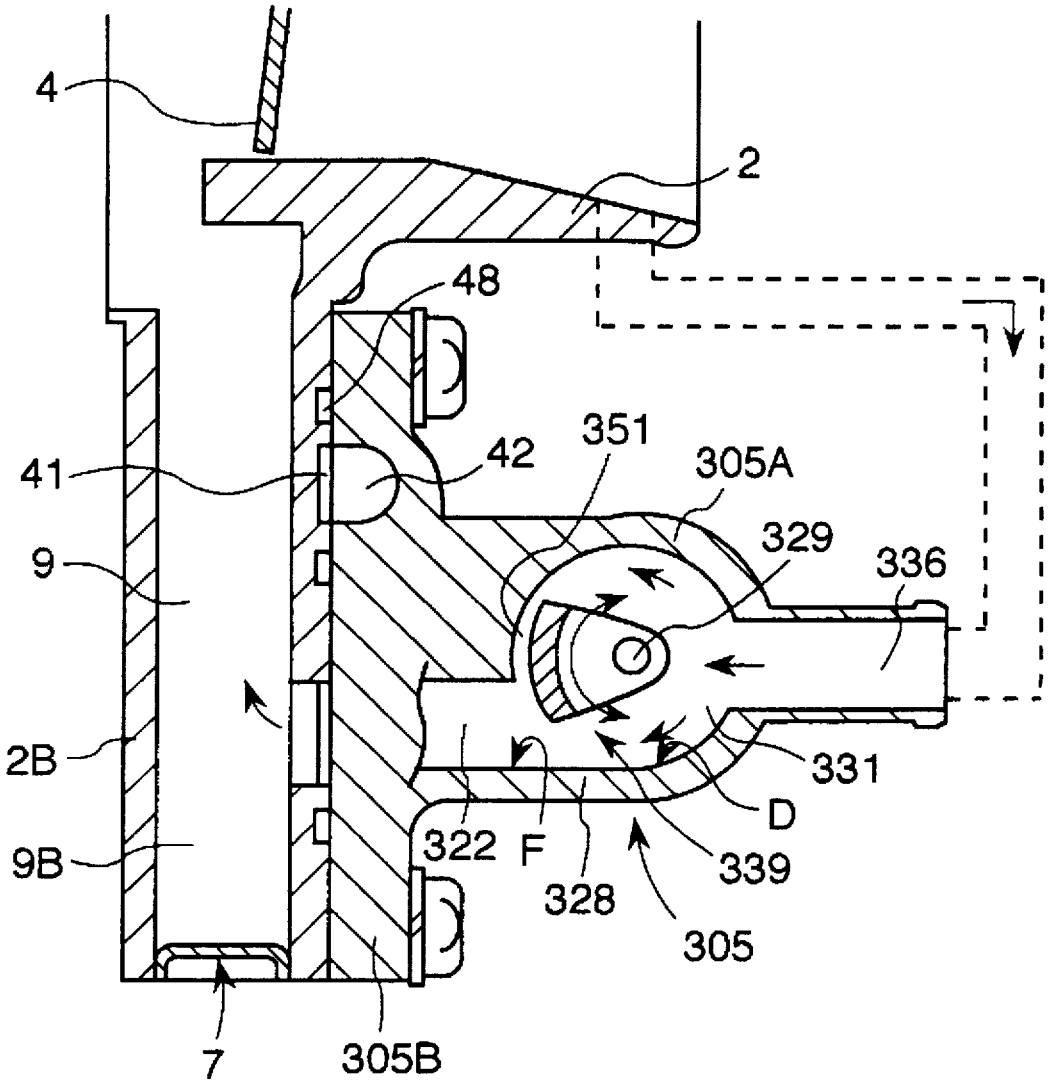
FIG. 21 is a sectional view of the air flow rate control apparatus as a sixth embodiment in the present invention in the same way as FIG. 2.

The sixth embodiment of the present invention will be explained by using FIG. 21. Same codes in FIG. 21 show same members in FIGS. 1 to 9. This embodiment relates to an air flow rate control apparatus installing a rotary type ISC valve.

In FIG. 21, the ISC valve 305 that in this embodiment has a valve main frame 305 A and an installation flange part 305B, and the valve main frame 305A has a valve housing 328, a rotary type valve body 334 which is rotatable in the valve housing 328, a stepping motor to actuate the valve shaft 329 not shown in the drawings, and the valve housing 328 having the valve chamber 331 constitutes the measuring part 339 by locating the valve body 334 in the valve chamber 331. In the valve chamber 331 of the valve housing 328, the air-inlet passage 336 connected to the upper flow side of the throttle valve 4 of the throttle body 2 and the air-outlet passage 322 opened in the perpendicular cavity 9 in the throttle body base part 2B are formed.

Here, the bottom end F (passage section bottom) of the air-outlet passage 322 is in the same level as the lower surface D of the valve chamber 331 which is the bottom end of the measuring part 339.

In the rotary type ISC valve 305, as the clearance 351 between the rotated valve body 334 and the valve housing 328 of the inner wall is so narrow that when the water pooled in the measuring part 339 invades the clearance 351 and if the water freezes, the alve body 334 becomes not to be moved. In this embodiment, as the water invaded in the measuring part 339 flows down into the water pool portion 9B of the throttle body base part 2B through the air-outlet passage 322, the icing in the measuring part may be prevented in the same way as in the first embodiment.

According to the present invention, in the air flow rate control apparatus having the idle revolution speed control apparatus under throttle body, icing of the measuring part in the idle revolution speed control apparatus may be prevented on the chilly time, thereby appropriate engine starting may be secured. Futhermore, as the water pooled in the water pool portion is absorbed into the engine from the boa of the throttle body by utilising the cranking negative pressure on the engine starting, the passage does not clog up with the carbon in the blow by gas and high reliability for iczing protection is secured.

Furtheremore, in order to drain the water in the water pool portion, there is no need to provide any special passage, construction therefor becomes extremely simple, too.

Furtheremore, in order to drain the water in the water pool portion, The layout design of engine room becomes easy.

What is claimed is:

1. An air flow rate control apparatus of an engine for controlling air flow rate according to condition of said engine comprising an idle revolution speed control apparatus installed under a throttle body and a throttle valve installed in a boa of said throttle body, upper flow side of said throttle body is connected with said boa detouring said throttle valve, characterized by further comprising, a water pool portion formed in an air passage led from a measuring part of said idle revolution speed control apparatus to the boa, said water pool portion having a closed bottom disposed at a low location than the measuring part and an upper part opened up in an air passage, wherein said air passage part between said measuring part and said water pool portion serves as the drain passage for falling the water in the measuring part into the water pool portion.

2. An air flow rate control apparatus of an engine as defined in claim 1, said apparatus characterized in that, a passage section bottom of said air passage part between the measuring part of the idle revolution speed control apparatus and said water pool portion is disposed in a same level as or lower than a bottom end of said measuring part.

3. An air flow rate control apparatus of an engine as defined in claim 1, said apparatus characterized in that, said air passage part between the measuring part of the idle revolution speed control apparatus and said water pool portion is inclined from an axial center of the measuring part.

4. An air flow rate control apparatus of an engine as defined in claim 1, said apparatus characterized by further comprising, an another water pool portion having a bottom part being in a same level as or lower than a bottom end of said measuring part in a part of said air passage led to said measuring part.

5. An air flow rate control apparatus of an engine as defined in claim 1, said apparatus characterized further comprising, a hot water passage led through both of said throttle body and said idle revolution speed control apparatus.

6. An air flow rate control apparatus of an engine for controlling air flow rate according to condition of said car engine comprising an idle revolution speed control apparatus installed under a throttle body and a throttle valve installed in a boa of said throttle body, upper flow side of said throttle body is connected with said boa detouring said throttle valve, characterized by further comprising, a cylinder portion forming said boa and a base part for installing said idle revolution speed control apparatus under said cylinder portion installed on said throttle body, a perpendicular cavity forming a part of said air passage led from said measuring part to said boa of said throttle body on the base part, and a water pool portion formed under said perpendicular cavity, a bottom part of said perpendicular cavity being lower than said measuring part, wherein said air passage part between said measuring part and said water pool portion serves as a drain passage where water in said measuring part falls into said water pool portion.

7. An air flow rate control apparatus of an engine as defined in claim 6, said apparatus characterized in that, a passage section bottom of said air passage part between the measuring part of the idle revolution speed control apparatus and said water pool portion is disposed in a same level as or lower than a bottom end of the measuring part.

8. A throttle body of an air flow rate control apparatus of an engine for controlling air flow rate according to condition of said car engine comprising an idle revolution speed control apparatus installed under a throttle body and said throttle valve installed in a boa of said throttle body, upper flow side of said throttle body is connected with said boa detouring said throttle valve, characterized by further comprising, a cylinder portion forming said boa and a base part having a jointing surface for installing said idle revolution speed control apparatus under said cylinder portion installed on said throttle body, a perpendicular cavity being arranged to the base part, a lower part being closed, an upper part of said cavity being led to said boa and a side part of said cavity being opened to said jointing surface, and a water pool portion formed under said perpendicular cavity, a lower part of the perpendicular cavity being lower than said side part.

9. An idle revolution speed control apparatus of a throttle body of an air flow rate control apparatus of an engine for controlling air flow rate according to condition of said car engine comprising an idle revolution speed control apparatus installed under a throttle body and said throttle valve installed in a boa of said throttle body, upper flow side of said throttle body is connected with said boa detouring said throttle valve, characterized by further comprising, an installation flange part having a jointing surface which is put together with a jointing surface of said base department arranged under than a cylinder portion of said throttle body, and an air passage opened to a jointing surface of said installation flange part and arranged on a position from a measuring part of said idle revolution speed control apparatus to said jointing surface, wherein a passage section bottom of said air passage is in a same level as or lower than a bottom end of said measuring part.

10. An air flow rate control apparatus of an engine for controlling air flow rate according to condition of said engine comprising an idle revolution speed control apparatus installed under a throttle body and a throttle valve installed in a boa of said throttle body, upper flow side of said throttle body is connected with said boa detouring said throttle valve, characterized by further comprising, a hot water passage passing through both of said throttle body and said idle revolution speed control apparatus.

11. An air flow rate control apparatus of an engine for controlling air flow rate according to condition of said engine comprising an idle revolution speed control apparatus installed under a throttle body and a throttle valve installed in a boa of said throttle body, upper flow side of said throttle body is connected with said boa detouring said throttle valve, characterized by further comprising, a hot water passage passing through both of said throttle body and said idle revolution speed control apparatus, a cylinder portion forming said boa and a base part having a jointing surface for installing said idle revolution speed control apparatus under said cylinder portion installed on said throttle body, and an installation flange part having a jointing surface installed on said jointing surface of said base part, wherein said hot water passage is opened to both of said jointing surface of said base part and said jointing surface of said installation flange part, and is located in a position extended over both of said base part and said installation flange part.

12. An air flow rate control apparatus of an engine as defined in claim 11, said apparatus characterized further comprising, a perpendicular cavity forming a part of said air passage led from said measuring part to said boa of said throttle body on the base part, and a water pool portion formed under said perpendicular cavity, a bottom part of said perpendicular cavity being lower than said measuring part, wherein said air passage part between said measuring part and said water pool portion serves as a drain passage where water in said measuring part falls into said water pool portion.

13. An air flow rate control apparatus of an engine as defined in claim 11, said apparatus characterized further comprising, an air passage formed on said base part of said throttle body, a part of said air passage being led from said measuring part of said idle revolution speed control apparatus to said boa of said throttle body and being opened to said jointing surface, an another air passage formed on said idle revolution speed control apparatus, an other part of said another air passage being led from said measuring part to said boa of said throttle body and being opened to said jointing surface of said installation frange part, and an oil seal of double ring type for sealing a prt opened to said air passage and a part opened to said hot water passage in said jointing surface.

14. A drain off method of an air flow rate control apparatus of an engine for controlling air flow rate according to condition of said engine comprising an idle revolution speed control apparatus installed under a throttle body and a throttle valve installed in a boa of said throttle body, an upper flow side of said throttle body is connected with said boa detouring said throttle valve, characterized by comprising the steps of, pooling a water in a measuring part of said idle revolution speed control apparatus in a water pool portion formed in an air passage led from a measuring part of the measuring part to said boa of throttle body while the engine is not actuated, absorbing to drain the water pooled in said water pool portion through said boa of said throttle body by utilizing cranking air negativ pressure when said engine is started.

* * * * *